US005984262A

United States Patent [19]

Parsons et al.

[11] Patent Number: 5,984,262

[45] **Date of Patent: *Nov. 16, 1999**

[54] OBJECT-SENSOR-BASED FLOW-CONTROL SYSTEM EMPLOYING FIBER-OPTIC SIGNAL TRANSMISSION

[75] Inventors: Natan E. Parsons, Brookline; Joel S. Novak, Sudbury, both of Mass.; Martin E. Marcichow, Hoffman Estates, Ill.

[73] Assignee: Arichell Technologies, Inc., West Newton, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/690,624

[22] Filed: Jul. 31, 1996

[51] Int. Cl.[6] ..... F16K 31/02; H01J 40/14

[52] U.S. Cl. ..... 251/129.04; 4/623; 250/221

[58] Field of Search ..... 251/129.04; 4/623; 250/221

[56] References Cited

U.S. PATENT DOCUMENTS

| | | | |
|---|---|---|---|
| 4,179,691 | 12/1979 | Keller | 340/567 |
| 4,282,430 | 8/1981 | Hatten et al. | 250/221 |
| 4,539,474 | 9/1985 | Takahata | 250/221 |
| 4,767,922 | 8/1988 | Stauffer | 250/221 |
| 4,902,887 | 2/1990 | Everett, Jr. | 250/221 |
| 4,915,347 | 4/1990 | Iqbal et al. | 251/30.03 |
| 4,938,384 | 7/1990 | Pilolla et al. | 250/221 X |
| 4,941,219 | 7/1990 | Van Marcke | 4/623 |
| 4,953,236 | 9/1990 | Lee et al. | 4/623 X |
| 4,972,070 | 11/1990 | Laverty, Jr. | 250/221 |
| 5,025,516 | 6/1991 | Wilson | 4/623 |
| 5,172,193 | 12/1992 | Payne et al. | 356/445 |

FOREIGN PATENT DOCUMENTS

| | | |
|---|---|---|
| 0015575 | 9/1980 | European Pat. Off. . |
| 0337367 | 10/1989 | European Pat. Off. . |
| 0446365 | 9/1991 | European Pat. Off. . |
| 0461349 | 12/1991 | European Pat. Off. . |
| 4241049 | 6/1994 | Germany . |
| 646765 | 12/1984 | Switzerland . |

OTHER PUBLICATIONS

Patent Abstracts of Japan, vol. 18, No. 463 (M–1664), Aug. 29, 1994 & JP 06 146356A (Toto Ltd), May 27, 1994.

*Primary Examiner*—John Rivell
*Attorney, Agent, or Firm*—Cesari and McKenna, LLP

[57] ABSTRACT

A control circuit (56) for responding to infrared light from a target region and operating an electric valve (54) in response is disposed at a protected location remote from the target region. It detects the presence of objects by means of light conducted to it by a fiber-optic cable (32).

2 Claims, 7 Drawing Sheets

OBJECT-SENSOR-BASED FLOW-CONTROL SYSTEM EMPLOYING FIBER-OPTIC SIGNAL TRANSMISSION

BACKGROUND OF THE INVENTION

The present invention concerns object-sensor-based fluid-flow control. It has particular, although not exclusive, application to flow-control systems in which the object to be sensed is located in an environment that is relatively hostile to the typical object sensor.

Automatic faucets and flushers for urinals and water closets typically operate in response to an object sensor. A typical installation employs an infrared-radiation source, such as a light-emitting diode, and an infrared-radiation sensor, such as a PIN diode circuit, that detects objects by sensing infrared radiation that reflects off the object.

Although such systems are simple in concept, certain practical considerations conspire to make them expensive to implement. The main factor is that the object tends to be located in an environment that is somewhat hostile to electronic sensor circuitry. An automatic-faucet user's hands, for instance, which are typical objects for the system to detect, are located in a water stream. This results in splashing and high humidity. The sensor mechanism must therefore be designed to withstand these environmental factors. Moreover, since automatic-faucet installations tend to be in public areas, they are particularly subject to rough treatment and even vandalism. A system designed to withstand these environmental factors has typically been relatively expensive.

SUMMARY OF THE INVENTION

We have conceived of a relatively simple and inexpensive way of reducing a system's vulnerability to such environmental factors. In accordance with our invention, the sensor and sensor circuitry are simply placed in a location that is less hostile to electronics, and we extend an optic-fiber signal line from the remote location to the relatively hostile location in which the reflected infrared is to be detected. Typically, we also transmit infrared light from the source to the object region by optic fibers. The optic fibers are relatively impervious to moisture and humidity, and they are readily housed in the necessarily robust faucet hardware. So the system's vulnerability to environmental factors is reduced in an inexpensive manner.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
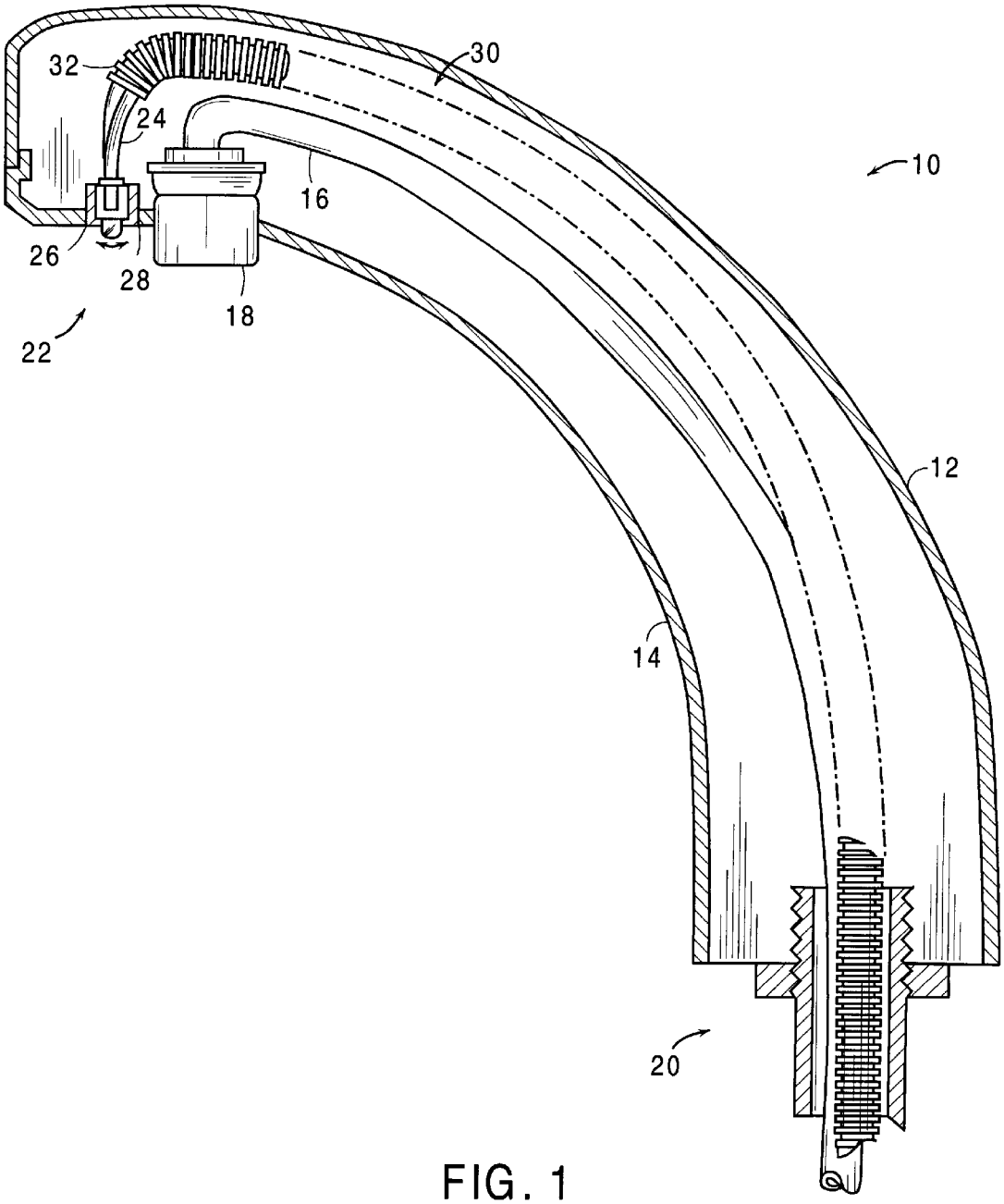
FIG. 1 is a cross-sectional view of a faucet spout employed in an embodiment of the present invention.

A faucet assembly 10 in FIG. 1 includes top and bottom spout members 12 and 14 that are secured to each other to provide an elongated enclosure that protects a fluid conduit 16 extending between an outlet device, such as an aerator 18, and a faucet mount 20 by which the spout is mounted to a sink or other base.

For automatic operation, an object in the region below the outlet 18 is to be detected by sensing infrared radiation generated—or, more typically, reflected—by that object at a reception location 22. To this end, a conventional automatic system employs a sensor located in region 22, and that sensor must be protected from hostile environmental factors such as moisture, humidity, and shock. Such protection exacts a significant cost and reduces the attractiveness of an automatic-control installation.

In contrast, a faucet that employs the teachings of the present invention has no electrical sensor in region 22. Instead, optic fibers 24 guide infrared radiation from region 22 to sensor circuitry, not shown in FIG. 1, that is disposed in a less-hostile location. As FIG. 1 shows, the fiber-optic line 24 can readily be run in a path adjacent to the fluid conduit 16 and can thereby be protected by the shell consisting of top and bottom spout members 12 and 14 in the same manner as that in which they protect the fluid conduit 16.

In the illustrated embodiment, the left end of one fiber-optic bundle 24 is mounted in a lens holder 26, in which is secured a lens 28 that gathers infrared radiation from a relatively wide area and focuses onto the end of the fiber-optic line 24 the part of the received infrared radiation whose angle of incidence is within a certain angular range. The use of a lens is not absolutely essential, but it is highly desirable, since it greatly enhances directionality and sensitivity.

In the illustrated embodiment, the lens holder 26 is mounted pivotably so that the target region's location can be adjusted. This is desirable because certain directions may be preferable in specific applications. That is, although it usually is not particularly critical where the hand or other object is when it is detected, the backgrounds of some target regions may, for instance, be so reflective that, by comparison, the incremental change contributed by an object of interest is too small to be reliably detected. This situation can usually be remedied by pivoting the lens holder.

Figure 2:
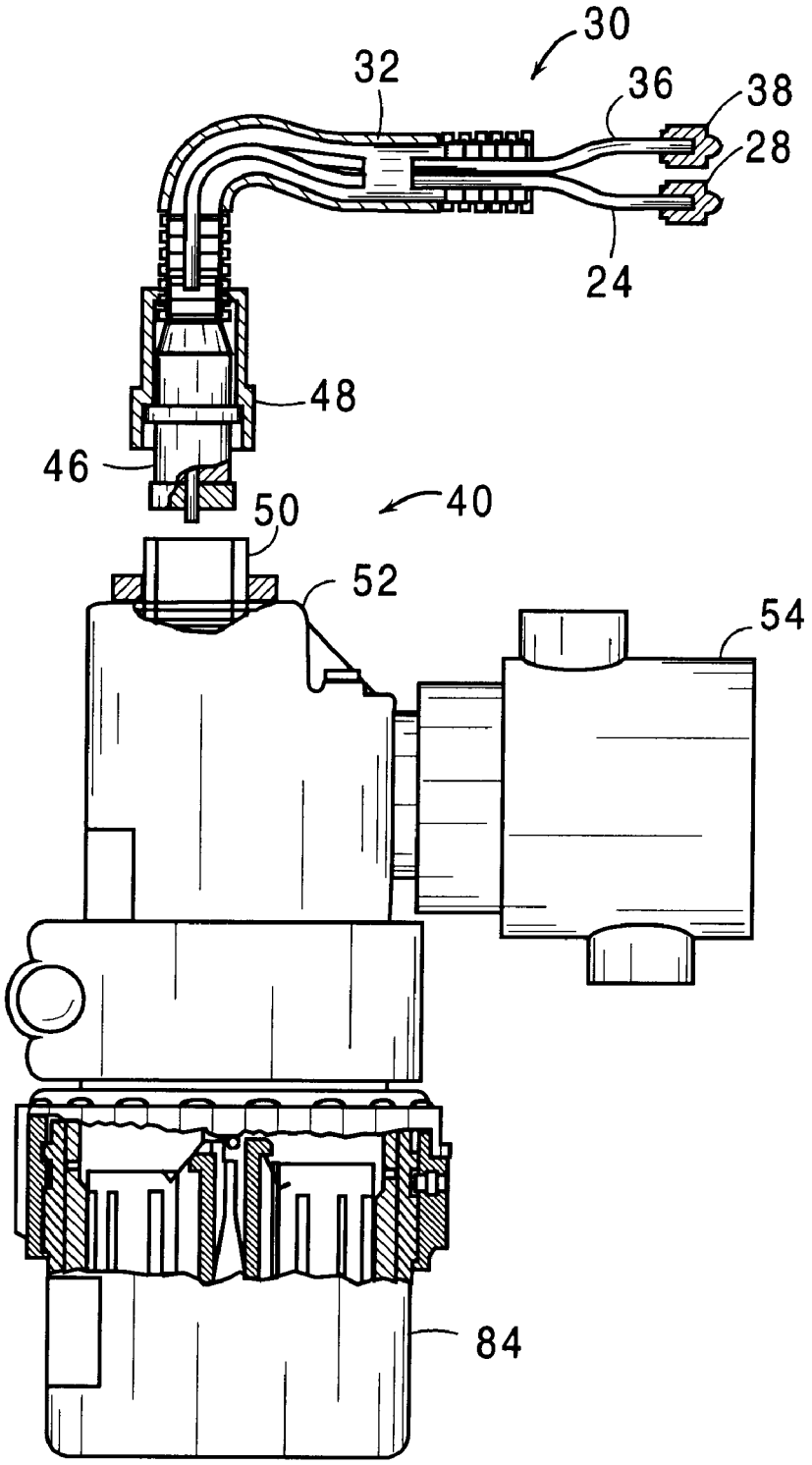
FIG. 2 is a side elevation, partly broken away, of the valve and sensor-control circuitry employed in an embodiment of the present invention.

In addition to the receiving fiber-optic line 24, whose purpose is to forward received infrared radiation from the target region to sensor circuitry, a fiber-optic cable 30 of which it is a part further includes a transmitter fiber-optic line 36, which conducts radiation from a source to the region where the target is to be illuminated. FIG. 2 depicts the fiber-optic cable 30 as including a sheath 32 that encloses the two fiber-optic cables 24 and 36. The receiving line 24 is terminated, as was described above, in a light-gathering lens 28. The other fiber-optic line 36 terminates in a second lens 38, which similarly tends to increase the directivity of target-region illumination and increase its intensity for a given source brightness.

The fiber-optic cable 30 terminates at a remote location 40 in a conventional fiber-optic plug 46, which a plug collar 48 secures onto a conventional fiber-optic receptacle 50 so as to hold the optic fibers 24 and 36 in optical communication with source and sensor elements mounted in a circuit housing 52 along with other electronics. The circuitry inside housing 52 acts as an object-detector circuit. Specifically, it generates and transmits infrared radiation into optic fibers 36 so that the source lens 38 at the proximal location receives the source radiation and concentrates it in the target region.

Figure 9:
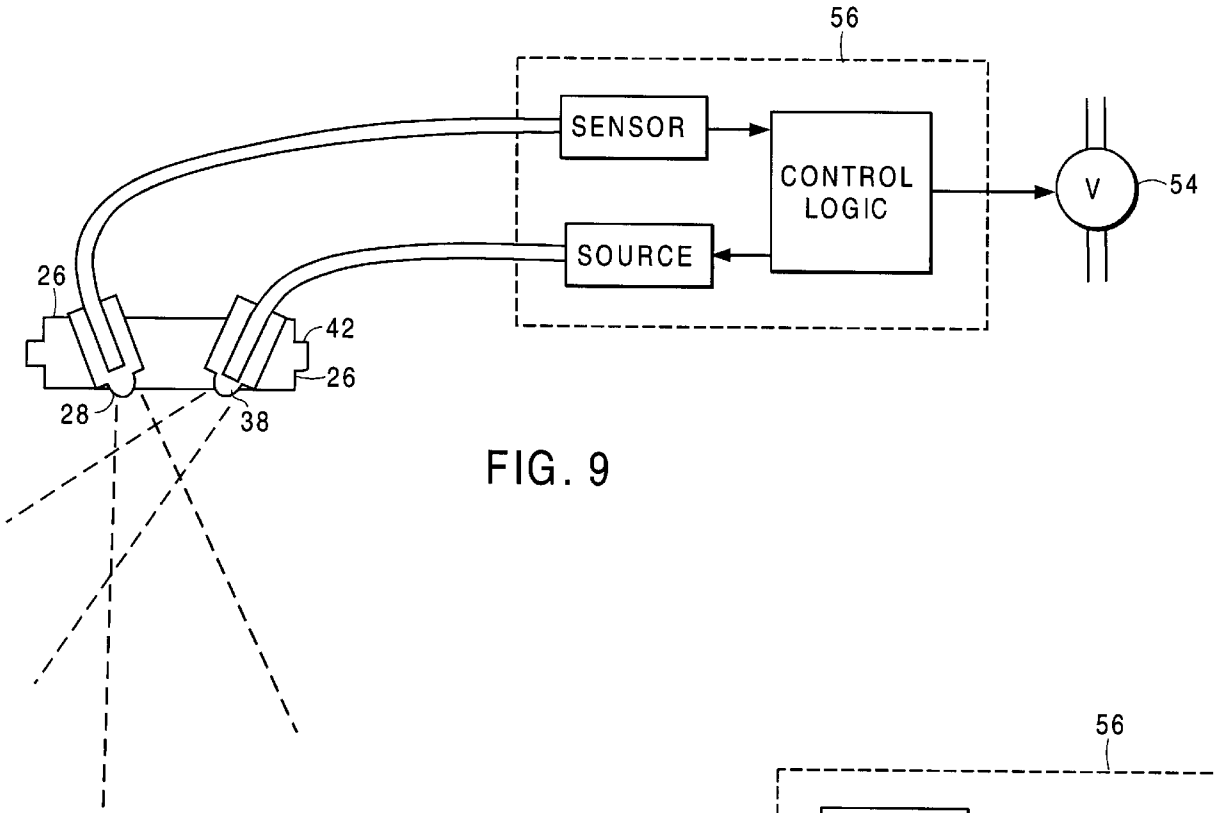
FIG. 9 is a diagrammatic view of the relationship between the system's target region and the orientations of the lenses that the illustrated embodiment employs.
Figure 10:
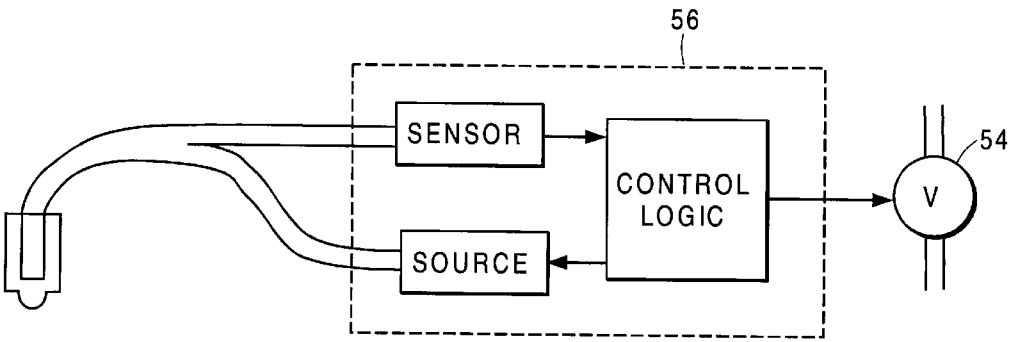
FIG. 10 is a diagrammatic view of the lens arrangement in an alternative embodiment.

As FIG. 9 illustrates, the lenses 28 and 38 are mounted at a slight angle to each other in a plane that contains the axis of the lens holder's pivot shaft 42. As a result, those lenses' fields of view intersect in the target region. The system therefore illuminates objects in the target region, and the reception lens 28 tends to receive the radiation that the object reflects as a result. The object detector's sensor circuitry in housing 52 senses the reflected infrared light and thereby detects such objects. In response, it controls an electrically operated valve 54 in accordance with predetermined criteria. If the resultant directional sensitivity can be dispensed with, the arrangement of FIG. 10 can be substituted. In that arrangement, a single lens is used both for the source and the reception fibers.

Figure 3:
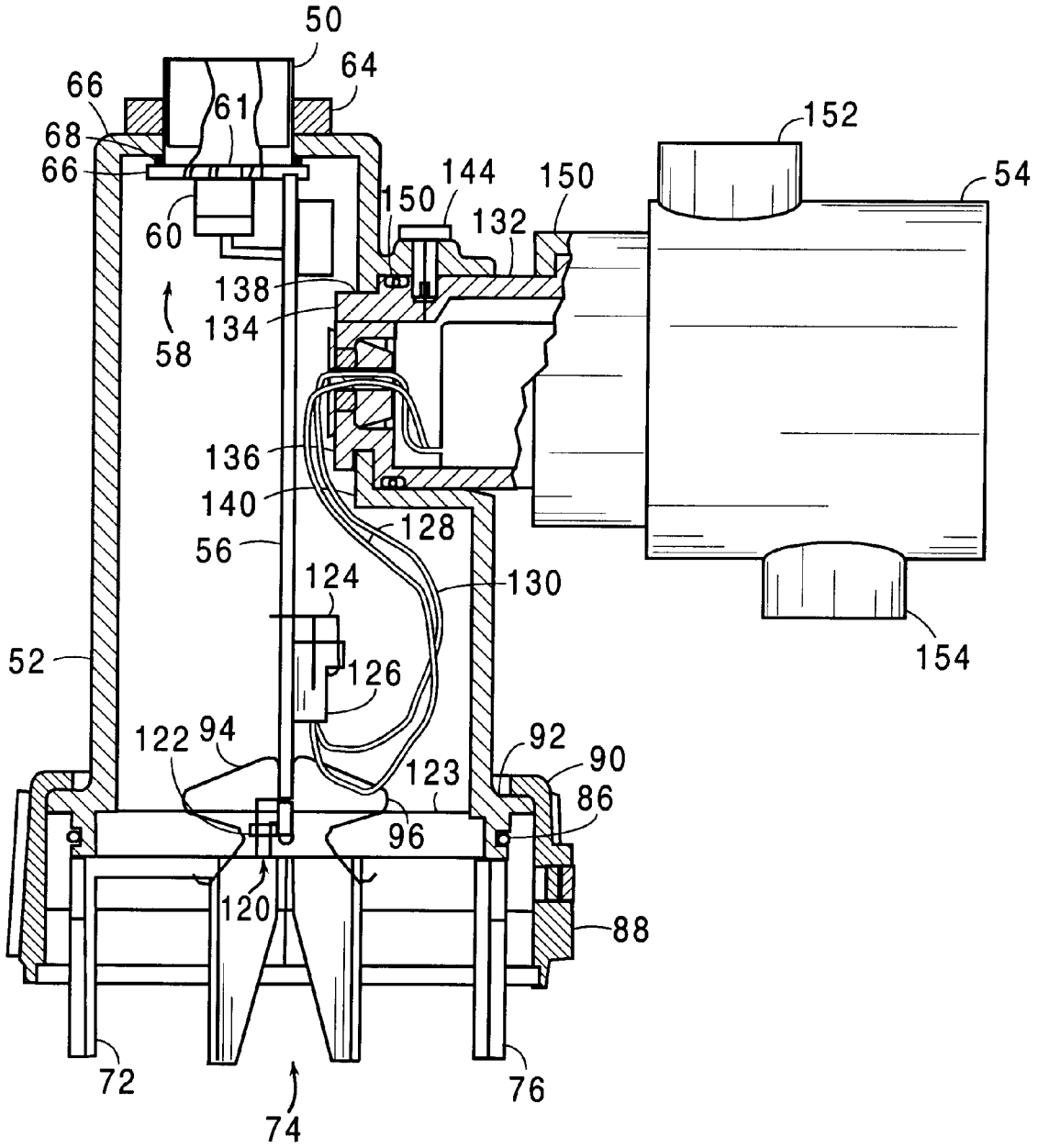
FIG. 3 is a more-detailed elevation, partly broken away, of the circuit housing and valve of the FIG. 2 embodiment.

FIG. 3 depicts the interior of circuit housing 52. A circuit board 56 of FIG. 3 provides the control circuitry for operating electric valve 54 in response to the sensed infrared radiation described above. Mounted on circuitry board 56 is an optical/electrical assembly 58, which includes the fiber-optic cable receptacle 50 in which a light-emitting-diode package 60 and PIN-diode circuitry (not shown) are mounted with it onto the circuit board 56. The light-emitting diode 60 converts electrical signals from the circuit board 56 into optical signals, which it transmits through an optical aperture 61 to the fiber-optic cable 30's source fibers 36 (FIG. 2), which register with the aperture 61. By way of another aperture, which is disposed behind aperture 61 and therefore is not shown in FIG. 3, light from the receiver fibers 24 (FIG. 2) reaches the PIN-diode circuitry which converts the reflected optical signal into an electrical signal.

A nut 64 that threadedly engages the exterior of the receptacle 50 draws it upward so as to cause its annular shoulder 66 to squeeze an 0-ring 68 into such a position as to seal the clearance that the socket 50 leaves in the housing opening in which it is disposed.

Since the circuitry board 56 is mounted to the optical/electrical assembly 58, the nut 64's fastening of the socket 50 to the housing 52 secures the circuit board 56 into place.

The type of control signals that the control circuitry applies to the electric valve 54 will depend on the type of valve operator that valve 54 includes. In a conventional solenoid-type operator, the control circuitry causes current to flow through the operator coil in order to keep the valve open, and it discontinues current flow in order to allow the valve to close. But it will be preferable in many applications of the present invention to employ latching valves, which require current to be driven through them only to cause them to change state, i.e., to go from the closed state to the open state or vice versa. No current is needed to cause the valve to remain either closed or open once the new state has been adopted.

Figure 4:
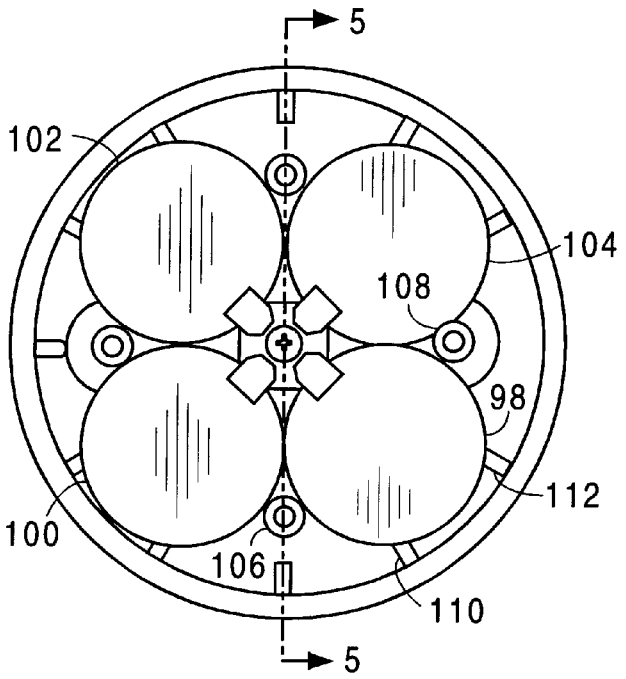
FIG. 4 is a cross-sectional view of the power pack employed in the embodiment of FIG. 2.
Figure 5:
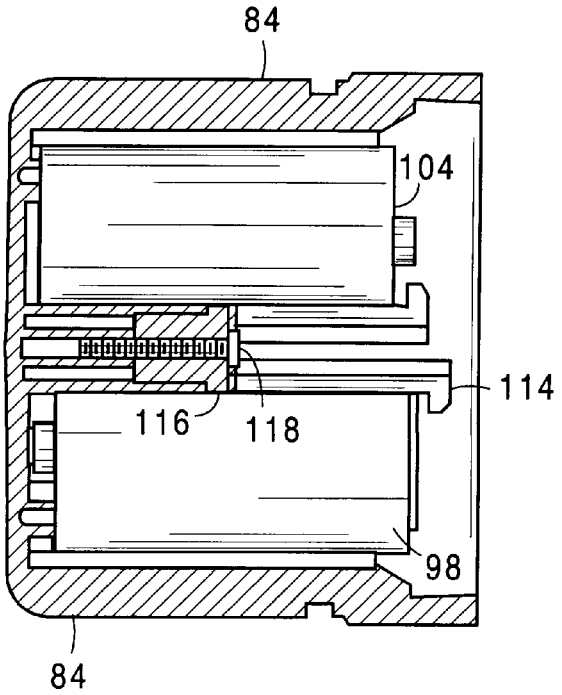
FIG. 5 is a cross-sectional view taken at lines 5—5 of FIG. 4.

Circumferentially spaced about the lower end of housing 52 are forked fingers 72, 74, and 76, which act together with ribs 78, 80, and 82 (FIGS. 4 and 5) to guide a power-pack housing 84 into the position shown in FIG. 2, where it sealingly engages an O-ring 86 (FIG. 3) and threadedly engages a retaining nut 88 whose annular lip 90 is rotably supported by a ledge 92 formed on the exterior surface of the circuit housing 52.

The circuit board 56 receives power through four spring contacts, of which FIG. 3 shows two, designated by reference numerals 94 and 96. These spring contacts engage respective ones of four batteries 98, 100, 102, and 104 (FIGS. 4 and 5) disposed in the power-pack housing 84. Locating posts 106 and 108 and ribs 110 and 112 position battery 98, which is secured in that position by a clip 114 formed by a clip spider 116 that a screw 118 secures to the power-pack housing 84. The other batteries are similarly located and secured.

As will be described below, circuit 56 can be set during assembly on installation to a desired one of several different operating modes.

For this purpose, circuit board 56 provides a set of contacts 120 that a user selectively connects by a jumper 122 before installation in order to select from among various modes of which the circuit board 56 is capable.

Shoulders (not shown) formed at the lower end of the circuit board 52 support a dust cover 123 through which the board 56, contact springs 94 and 96, and contacts 120 protrude.

The circuit board 56 applies control signals to the electric valve through a plug 124 that mates with the valve's lead socket 126, and thus with its control leads 128 and 130.

FIG. 3 shows that the valve assembly 54 is mounted by way of an extension member 132 that terminates in circumferentially spaced bayonet tabs 134 and 136. For assembly, these tabs are aligned with corresponding recesses that corresponding circumferentially spaced enclosure tabs 138 and 140 on the circuit housing define so that tabs 134 and 136 can enter the interior of the enclosure 52. Extension 32 is then rotated to an orientation in which tabs 134 and 136 are aligned with tabs 138 and 140 so as to secure the valve assembly on the circuit housing, and a locator screw 144 holds extension 132 in that orientation.

The extension surfaces that form apertures through which the valve leads 128 and 130 extend sealingly engage those leads, and an O-ring 150 similarly forms a seal between the extension 132 and the circuit housing 52. These seals, together with those provided by O-rings 68 and 86, protect the circuitry inside housing 82 from any external moisture.

The valve assembly 54's main body member 150 is rotatably mounted on its extension 132 to allow for flexibility in the angular relationship between the circuit housing 52 and the conduit (not shown) in which the valve assembly 54 is interposed by engagement with the valve assembly's inlet and outlet ports 152 and 154.

Figure 6:
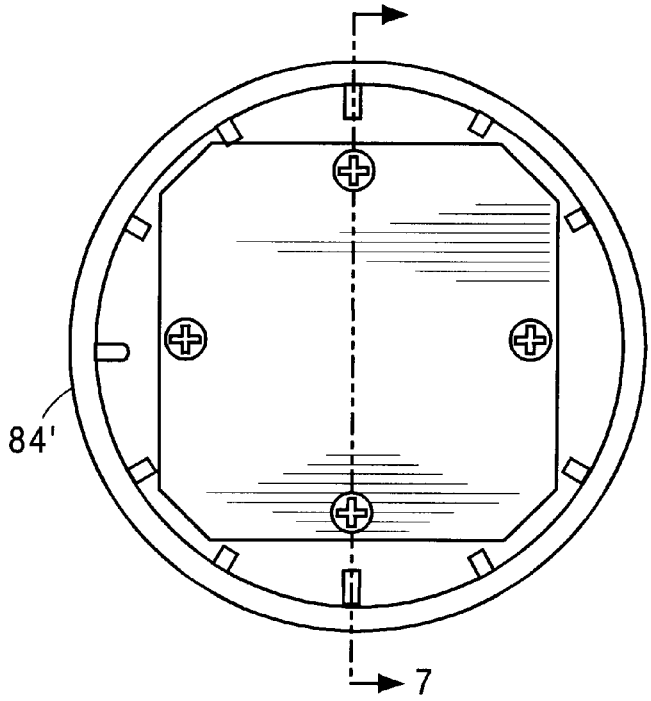
FIG. 6 is a cross-sectional view of an alternative embodiment of the power pack.
Figure 7:
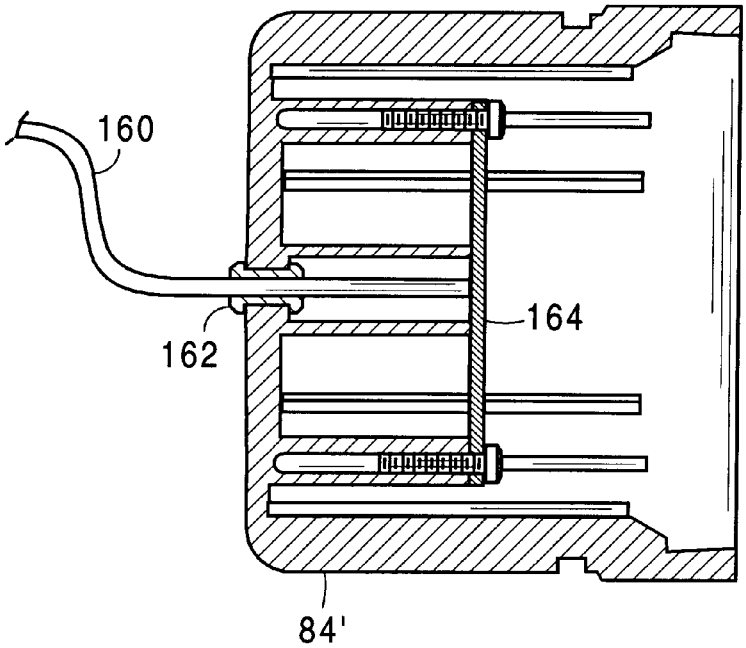
FIG. 7 is a cross-sectional view taken at lines 7—7 of FIG. 6.

As is indicated by a line-power cord 160 (FIG. 7) that enters an alternative power-pack enclosure 84' (FIGS. 6 and 7) by means of a strain-relief grommet 162 and connected to a signal-conditioning board 164 mounted in housing 84, a mechanical arrangement similar to the battery-operated system described above can be employed if line power is used in place of battery power.

Figure 8:
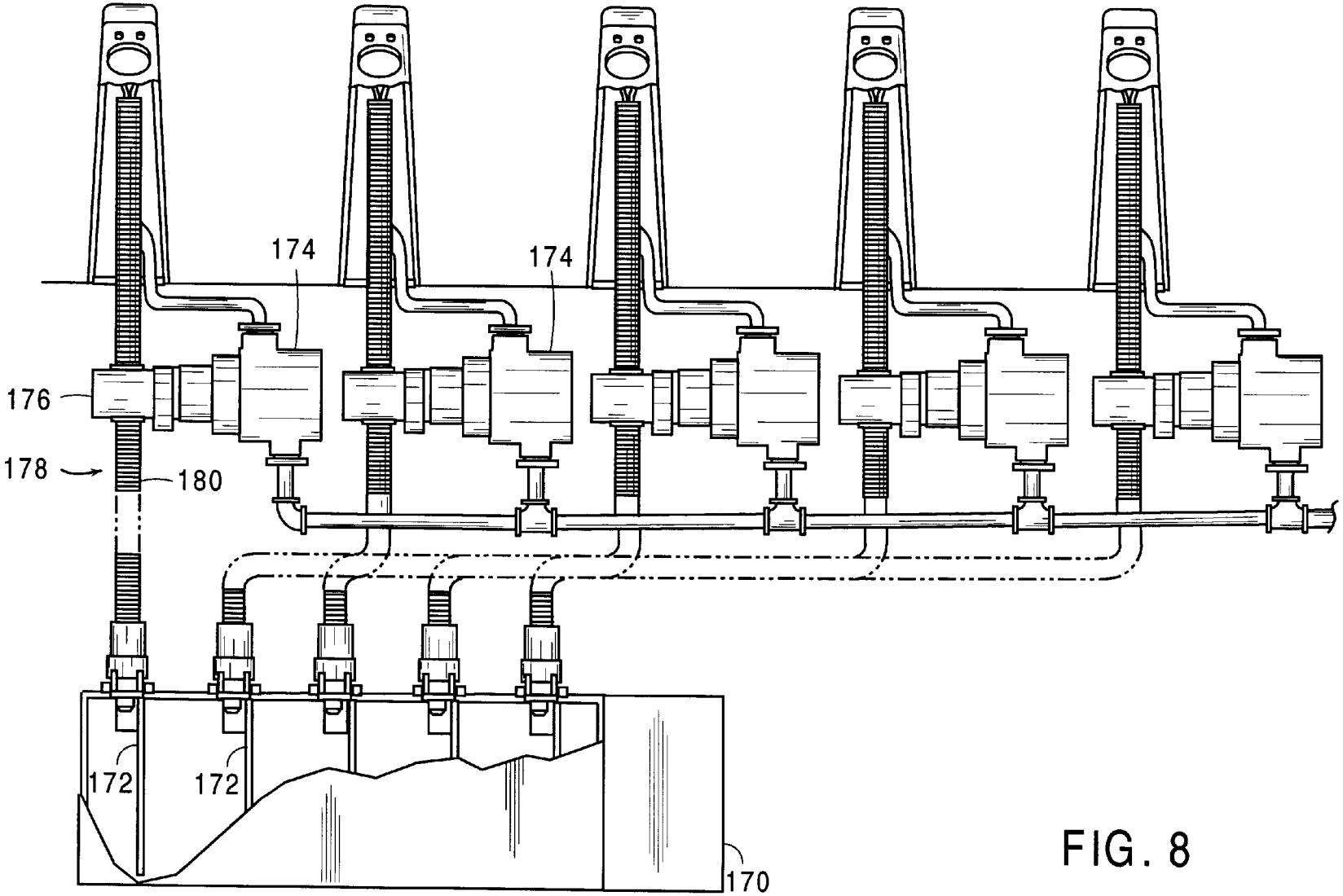
FIG. 8 is a diagrammatic view of a multiple-faucet embodiment of the present invention.

Although the valve assembly 54 of FIG. 2 is disposed closely adjacent to the circuit enclosure 52, other embodiments of the invention may employ a different mechanical arrangement. In FIG. 8, for instance, a common circuit housing 170 contains a plurality of circuit boards 172 for a plurality of corresponding plurality of valves 174. In the FIG. 8 arrangement, ajunction box 176 is interposed in the fiber-optic cable 178 between the lenses 180 and the circuit enclosure 170. Inside the junction box 176, the valve leads join the fiber-optic lines inside the cable 178's exterior sheath 180 and extend inside down to the corresponding circuit board 172 so that the valve 174 can receive control signals from board 172. The other valves are similarly controlled.

In accordance with the invention's broader aspects, the particular strategy employed in determining whether the valve is to be in its open or closed state is not critical. Many existing infrared-based object-detection arrangements are commercially used for this purpose, and all can take advantage of the invention's broader aspects. To illustrate the invention's breadth, however, we discuss below a range of strategies that we consider useful. Many systems have their receiver sensitivities adjusted by an installer to a level at which no response is detected in the absence of a target. Although this approach can be used with certain of the invention's aspects, we prefer whenever possible to have the circuit automatically calibrate itself so that the no-target level is a detectable baseline level. Instead of adjusting receiver sensitivity, moreover, we prefer to find the transmitter output level that will yield a predetermined level of received radiation. The circuitry that drives the light-emitting diode is variable, being responsive to control signals applied to it to vary the LED's output intensity. Control circuitry included on board 56 responds to the light-sensitive diode's output by driving the LED at such a level as to maintain a predetermined level of optical radiation, as indicated by the receiver diode. The drive signal needed to achieve this predetermined level is therefore an indication of how much reflection is occurring. By operating in this manner, the system employs only as much power as is needed to achieve the detectable level of reflection.

This power level typically is the result of reflection from a sink. However, it sometimes occurs that there is so little reflection as to be essentially undetectable. In that case, of course, the predetermined level of reflected power cannot be achieved, and the system accordingly transmits at a predetermined default level.

As will be explained below, water will not be permitted to flow for longer than a predetermined maximum, regardless of the level of received radiation. If the valve is turned off as a result of having been open for such a duration, the unit performs its calibration operation. That is, calibration occurs not just upon initial installation or battery replacement. However, during the first ten minutes after a battery is installed, the unit will additionally operate a beeper provided in the control circuitry. The circuitry issues a series of rapid beeps (0.3 second between beeps) when it detects a valid target. It beeps at a slower rate (0.6 second between beeps) when a target is detected but the maximum time limit has been exceeded. An audible indication of the system's operation is thereby provided to the battery installer. After the first ten minutes, the audible signal is discontinued.

A target is taken to be present when the difference between the detected and baseline levels exceeds a predetermined increment. The increment between the baseline value and the detected value that is taken as an indication of a valid target can be a fixed threshold, but we prefer to vary the threshold in accordance with factors such as whether the baseline level is non-zero, how long it has been since the water was last turned on or off, etc. Generally speaking, the required increment is least if the baseline value is zero and it is greatest just after the valve has been closed.

When the level of received radiation indicates that a valid target is present, the control circuit opens the valve after an initial time delay. The time delay depends on the difference between the baseline value and the detected value; the larger the difference, the shorter the initial time delay. We prefer an initial-time-delay range of between 100 milliseconds and 600 milliseconds. Additionally, we impose a required delay between the time at which the valve closes and that at which it is permitted to be opened again. We impose a one-second delay for this purpose.

In a typical application, the system will close the valve if the absence of a valid target continues for 1.2 seconds.

But we provide jumper-selected options for selecting among certain different approaches. In one such approach, the valve remains open for a predetermined length of time, regardless of whether a target has been present throughout that time and regardless of whether target is still present at the end of that time. For instance, if a target is initially detected, the valve may be held open for the predetermined duration of, say, 3 seconds even if the target has disappeared before then, and it will close at the end of the 3 seconds even if a target remains. Moreover, the valve will remain closed so long as the target remains, unless it is removed for at least 1.2 seconds and then returned.

In another, "on-demand" mode of operation, the duration for which the valve remains open is 1.2 seconds longer than that for which the target is present, subject to an maximum continuous-detection duration. If the maximum is, say, 30 seconds, then the valve will close after a target has been detected continuously for 30 seconds. However, if the target is removed momentarily-for a duration less than the 1.2-second delay required before valve closure-the 30-second duration is reset, so the total duration for which the valve is open can exceed the 30-second intermediate limit. But we prefer to impose an additional absolute limit whose timing cannot be reset. Specifically, we impose an absolute maximum duration of 20 minutes for which the valve can be left in its open state.

In the on-demand mode, we prefer to perform recalibration automatically during extended open-state periods that result from the intermediate time duration's being reset. The ordinary desirable result is that the system will become de-sensitized to a target that has been located in the target region for an extended period of time. Therefore, the 20 minute absolute limit is reached only in unusual circumstances.

It is apparent from the foregoing description that the present invention's teachings can be employed in a wide range of embodiments. The invention therefore constitutes a significant advance in the art.

What is claimed is:

1. An automatic flow-control system comprising:

A) a conduit, having an inlet and an outlet, for conducting to its outlet fluid received at its inlet;

B) an electrically operated valve interposed in the fluid conduit and operable by application of control signals thereto between an open state, in which it permits fluid flow from the conduit inlet to the conduit outlet, and a closed state, in which it prevents fluid flow from the conduit inlet to the conduit outlet;

C) a variable optical-radiation source for generating optical radiation and shining it into a target region, the optical-radiation source being responsive to control signals applied thereto to vary the intensity of the optical radiation that it generates;

D) a sensor circuit for detecting optical radiation reflected by objects in the target region and for applying control signals to the electric valve to control fluid flow there-through in response to at least one predetemined characteristic of the sensed optical radiation; and E) control circuitry responsive to the sensor circuit for applying control signals to the optical-radiation source to cause it to generate optical radiation whose intensity results in a predetermined level of optical radiation received by the sensor circuit.

2. An automatic flow-control system comprising:

A) a conduit, having an inlet and an outlet, for conducting to its outlet fluid received at its inlet;

B) an electrically operated valve interposed in the fluid conduit and operable by application of control signals thereto between an open state, in which it permits fluid flow from the conduit inlet to the conduit outlet, and a closed state, in which it prevents fluid flow from the conduit inlet to the conduit outlet;

C) a mounting member disposed at a proximal location near a target region;

D) a lens holder pivotably mounted on the mounting member for pivoting among different angular positions;

E) a fiber-optic cable including separate source and reception optic fibers mounted at one end in the lens holder and extending to a remote location;

F) an optical-radiation reception lens mounted in the lens holder to receive and focus into the reception optic fiber optical radiation from a field of view in the target region that changes as the lens holder is pivoted so that the reception optic fiber conducts to the remote location the radiation thereby focused into the reception optic fiber by the reception lens;

G) an optical-radiation source, disposed at the remote location for shining into the source optic fiber radiation that the source optic fiber thereby conducts to the proximal location;

H) an optical-radiation source lens mounted in the lens holder and disposed adjacent the source fiber-optic cable at the proximal location for receiving optical radiation from the source optic fiber and directing it into the target region in a direction that changes as the lens holder pivots; and I) a sensor circuit disposed at the remote location for detecting the presence of objects in the target region by sensing optical radiation forwarded by the fiber-optic cable from the target region to the remote location and for applying control signals to the electric valve to control fluid flow there-through in response to at least one predetermined characteristic of the sensed optical radiation.

* * * * *

UNITED STATES PATENT AND TRADEMARK OFFICE

CERTIFICATE OF CORRECTION

PATENT NO : 5,984,262

DATED : November 16, 1999

INVENTOR(S) : Natan E. Parsons et al.

It is certified that error appears in the above-identified patent and that said Letters Patent is hereby corrected as shown below:

In the cover page's Assignee field, after

"Arichell Technologies, Inc.
West Newton, Mass.", insert:

--Sloan Valve Company
Franklin Park, Illinois--

Signed and Sealed this

Twenty-ninth Day of August, 2000

*Attest:*

*Attesting Officer*

Q. TODD DICKINSON

*Director of Patents and Trademarks*